United States Patent [19]

Seragnoli

[11] 4,336,813

[45] Jun. 29, 1982

[54] STRIP GUIDING DEVICE, PARTICULARLY FOR CIGARETTE MAKING MACHINES

[75] Inventor: Enzo Seragnoli, Bologna, Italy

[73] Assignee: G.D. Società per Azioni, Bologna, Italy

[21] Appl. No.: 190,797

[22] Filed: Sep. 25, 1980

[30] Foreign Application Priority Data

Oct. 8, 1979 [IT] Italy ..... 50484 A/79

[51] Int. Cl.[3] ..... A24C 5/04; A24C 5/20; A24C 5/14; A24C 5/31

[52] U.S. Cl. ..... 131/84 C; 131/60; 226/95

[58] Field of Search ..... 131/60–69, 131/84 B, 84 C, 84 R, 84 A, 105; 226/95; 198/689

[56] References Cited

U.S. PATENT DOCUMENTS 3,142,428 7/1964 Faeber ..... 226/95
3,270,932 9/1966 Smith, Jr. ..... 226/95
3,491,769 1/1970 Gomann ..... 131/84 B

FOREIGN PATENT DOCUMENTS 6804233 3/1969 Switzerland ..... 131/60
719743 12/1954 United Kingdom ..... 131/60

*Primary Examiner*—V. Millin
*Attorney, Agent, or Firm*—Merriam, Marshall & Bicknell

[57] ABSTRACT

A strip guiding device particularly suitable for being used with cigarette manufacturing machines for the automatic forward movement of at least a strip along a substantially U-shaped path, the said device comprising a hollow pulley around which a central curved section of the said path extends, at least a chamber disposed along the said path downstream with respect to the said pulley and suction means communicating with the said chamber and with the interior of the said hollow pulley, the walls of this latter which extend along the said path being perforated, and an air-permeable belt conveyor extending at least along the perforated wall of the said chamber.

5 Claims, 6 Drawing Figures

STRIP GUIDING DEVICE, PARTICULARLY FOR CIGARETTE MAKING MACHINES

BACKGROUND OF THE INVENTION

The present invention relates to a strip guiding device adapt to allow disposing strips of a material, in particular straps of paper, around at least a transmission pulley.

Although in the following description reference will be made only to cigarette making machines, it is clear that the strip guiding device of the present invention may be applied to all those machines in which a strip of material, particularly paper, is made to advance along a non rectilinear path which can with difficulty be approached by an operator.

The cigarette making machines usually comprise a feed assembly inside which a strip of paper from a reel is fed through a plurality of operative assemblies till it reaches a deflector pulley around which the strip is wound to continue then moving horizontally on a bench along which it is progressively bent in a transversal direction to form a continuous cylinder. Adjacent the said deflector pulley the strip or web of paper which advances along the said bench receives a continuous carpet of cut tobacco which is then enclosed inside the said continuous cylinder so as to form a continuous cigarette rod.

When, during the operation of the cigarette making machine, the strip of paper breaks upstream with respect to the said deflector pulley, a sensor which usually is disposed on the path followed by the strip of paper automatically stops the cigarette making machine, thus allowing the operator to intervene. Among the various operations which the operator has to carry out in order to place the machine in service, one of the most complicated is certainly that of rewinding the strip of paper around the said deflector pulley and making it to pass into the space, usually narrow, between the said bench and the end of a conveyor which supplies the said tobacco carpet.

Such operation, which is difficult to carry out even on a cigarette making machine operating with a single cigarette rod, becomes almost impossible when it has to be carried out on a machine operating with a double cigarette rod, i.e. a machine apt to simultaneously produce two cigarette rods. In fact, in the machine of this latter type the strips of paper are two and have to be wound around respective deflector pulleys disposed coaxially, before advancing along the bench on which the cigarette rods are formed. Accordingly, one of the said two deflector pulleys is completely covered by the other with respect to the operator who has to intervene, and, consequently, substantially inaccessible.

SUMMARY OF THE INVENTION

It is an object of the present invention to provide a strap guiding device which will allow to automatically dispose a strap around a pulley, without having to carry out any manual operation. It is a particular object of the present invention to provide a strip guiding device adapted to be mounted in a cigarette making machine, in particular a cigarette making machine operating with two cigarette rods, in order to allow to automatically dispose at least a strip of paper around a respective deflector pulley located immediately upstream of a bench serving to form at least a cigarette rod. The said object is attained by the present invention which relates to a strip guiding device, particularly for the automatic forward movement of at least a strip of paper along a substantially U-shaped path comprising a first and a second end branch connected to one another by an intermediate curved section, at least the said second branch, disposed downstream of the said curved section in the advancement direction, extending, at least partially, along a conveyor device for the forward movement of the said strip, the said strip guiding device being characterized in comprising at least a perforated pulley pivotally mounted around an axis passing through the centre of curvature of the said curved section, at least a chamber having a perforated wall disposed along at least the said second branch in contact with the said conveyor device, and suction means which communicate with the interior of the said pulley and the said chamber; a portion of the periphery of the said perforated pulley defining the said curved section of the path, and the remaining portion of the periphery of the said perforated pulley cooperating in a fluid-tight fashion with a fixed cylidrical surface; and the said conveyor device comprising an air-permeable ring belt conveyor.

BRIEF DESCRIPTION OF THE DRAWINGS

Further characteristics and advantages of the present invention will be apparent from the following description with reference to the accompanying drawings which represent, by way of non limiting examples, some embodiments of the invention and in which.

DETAILED DESCRIPTION OF THE INVENTION

Figure 1:
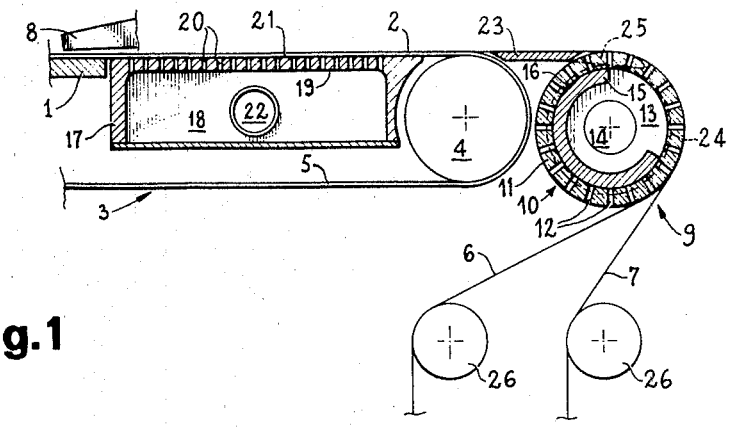
FIG. 1 is a diagrammatic axial section of a first embodiment of the strip guiding device according to the present invention.

FIG. 1 shows the inlet end of a rod forming bench 1 of a cigarette making machine. Bench 1 is fixed in a substantially horizontal position to a frame (not shown) of the cigarette making machine and slidably supports the upper runs 2 of two belt conveyors 3 disposed side by side, formed in such a way as to be permeable to air, one of which is visible in the drawing.

At the opposite ends of the bench the said frame pivotally rotatably supports two pulleys of which only one, disposed at the inlet of the bench 1 and indicated by reference numeral 4, is shown in the drawing, and about which the belt conveyors 3 are passed to form each a continuous ring whose lower run, indicated by reference numeral 5, extends below the bench 1.

The upper runs 2 of the belt conveyors 3 are arranged to displace, along the upper surface of the bench 1, the respective paper strips 6 and 7, above each of which a carpet of cut tobacco (not shown) is fed by means 8 a known feed device of which the terminal end is shown in the drawing.

As shown in FIG. 1, the strips of paper 6 and 7 are guided above the inlet ends of the upper runs 2 of the respective belt conveyors 3 by means of a strip guiding device which is indicated generally by reference numeral 9 and has, as will be better described later, the particular characteristic allowing, during the start or in case of a break of one or both strips 6 and 7, the automatic feed of the end of these straps above the said runs 2, without requiring any manual operation to be carried out by an operator.

Device 9 comprises a pulley 10 formed by a pipe 11 having a plurality of uniformly spaced radial holes 12 and disposed horizontally in a position adjacent the pulley 4 on the opposite side of this latter with respect to the inlet end of the bench 1.

The pulley 10 is rotatably supported by the frame (not shown) of the cigarette making machine so as to rotate, under the thrust of actuator means (not shown), about a horizontal axis parallel to the rotation axis of the pulley 4. Pipe 11 defines a cylindrical chamber 13 communicating, on one hand, with the exterior through the holes 12 and, on the other hand, with a suction device (not shown) of which an inlet conduit 14 extends axially towards the exterior from the chamber 13. Accomodated in the interior of this latter in a fixed position with respect to the said frame of the cigarette making machine is a shield member 15 externally limited by a cylindrical surface 16 which extends through an angle of at least 180°. The surface 16 is coaxial to the pulley 10 and cooperates in air-tight fashion at least with that of the two halves of the cylindrical inner surface of the pipe 11 which is turned towards the pulley 4.

Device 9 comprises also a box 17 shaped substantially as a rectangular parallelepiped and disposed in fixed position between the inlet end of the bench 1 and the pulley 4. The box 17 has an inner chamber 18 limited at the upper portion by a substantially horizontal plane wall 19 provided with a plurality of uniformly spaced through holes 20 and with an outer surface 21 which is substantially coplanar with the upper surface of the bench 1 and disposed in contact with the lower surface of the upper runs 2 of the belt conveyors 3.

Chamber 18 communicates, on one hand, with the exterior through the holes 20 and, on the other hand, with the said suction device (non shown), a further inlet conduit 22 of this latter extending axially towards the exterior from a side wall of the box 17.

Disposed in a fixed position between the pulleys 4 and 10 is a connection plate 23 limited at the upper portion by a horizontal plane surface coplanar with respect to the upper surface of the upper runs 2 of the belt conveyors 3 and tangent with respect to the outer surface of the pulley 10. Disposed on the outside of the latter are a plurality of annular grooves 24 each of which is slidably engaged by a respective projection 25 extending in a horizontal direction from the plate 23 towards the pulley 10.

As shown in FIG. 1, each of the two paper strips 6 and 7 is fed from the lower part to a respective deflector pulley 26 and, consequently, above the upper run 2 of the respective belt conveyor 3 along a substantially U-shaped path. This latter comprises a curved section extending in contact with a portion of the outer surface of the pulley 10 and connecting a first rectilinear section extending between the pulleys 26 and 10, to a second rectilinear section extending above and in contact with the plate 23 and the upper surface of the run 2 of the respective belt conveyor 3. In particular, the curved section of the said U-shaped path extends along that portion of the periphery of the pulley 10 in which the holes 12 are not occluded internally by the shield member 15 and, consequently, are in direct communication with the conduit 14.

In use, when the strips of paper 6 and 7 are to be mounted around the pulley 10 and above the bench 1 at the beginning of the operations or successively in case of a break of one or both strips 6 and 7 after the operations have been initiated, the strips 6 and 7 are made to advance at a reduced speed until their free ends result in being disposed above the pulleys 26 and adjacent the pulley 10 which rotates at a reduced speed together with the pulley 4 of the belt conveyors 3. By actuating at this point the said suction device (not shown) it is possible to create a depression in the interior of the chambers 13 and 18 and, consequently, air is drawn through the holes 20 and through the holes 12 which have been left free from the shield member 15.

Accordingly, the ends of the strips 6 and 7 are drawn into contact with the outer surface of the pulley 19 which, being rotated, disposes the said ends above the projections 25 and gives rise to the advancement of the strips 6 and 7 above the plate 23 and an initial section of the upper runs 2 of the respective belt conveyors 3. The connection between these latter and the strips 6 and 7 is ensured by the said suction device (not shown) which, sucking air through the belt conveyors 3 at the holes 20, produces the adhesion of the strips 6 and 7 to the corresponding belt conveyors 3 above the box 17 and, thus, the correct forward movement of the strips 6 and 7 along the bench 1. Of course, after the strips 6 and 7 have been disposed around the pulley 10 and made to advance along the bench 1, the suction of air through the conduits 14 and 22 is interrupted. In this connection it is suitable to note that the activation and the deactivation of the said suction device may be controlled manually by the operator or automatically by means of a control circuit (not shown) adapted to detect, after the cigarette making machine has been started, the presence or absence of the strips 6 and 7 upstream of the inlet end of the bench 1.

Figure 2:
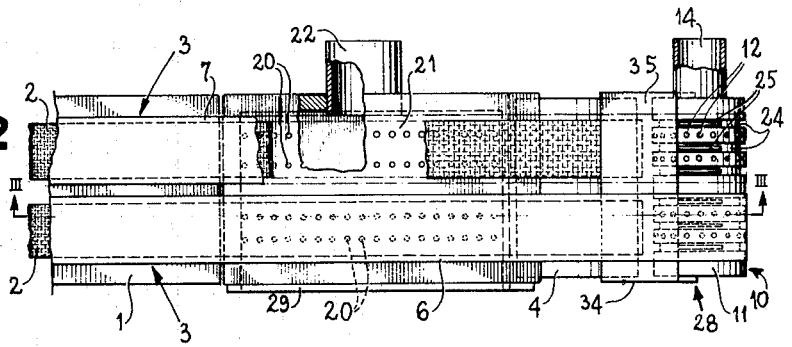
FIG. 2 is a plan view of a second embodiment of the strip guiding device according to the present invention.
Figure 3:
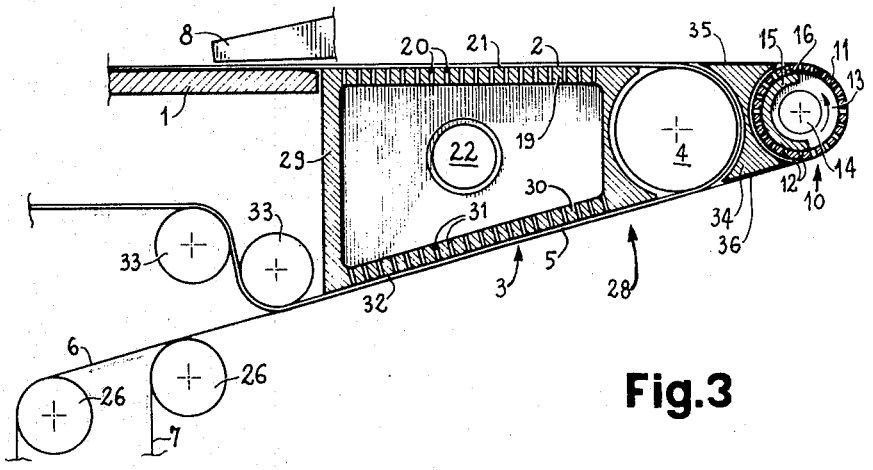
FIG. 3 is a section along line III—III of FIG. 2.

The embodiment shown in FIGS. 2 and 3 relates to a strip guiding device 28 similar to the device 9 from which it differs mainly in that it comprises a box 29 which is similar to the box 17, but has, besides the perforated wall 19, a lower wall 30 traversed by through holes 31 and externally limited by a plane surface 32 inclined towards the wall 19 and the pulley 4 and substantially tangent to this latter and to the pulley 10.

Figure 4:
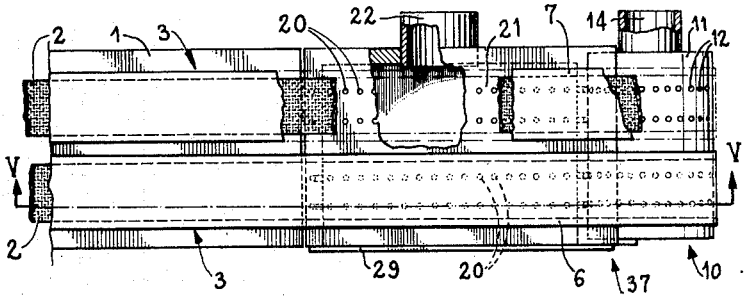
FIG. 4 is a plan view of a third embodiment of the strip guiding device according to the present invention.
Figure 5:
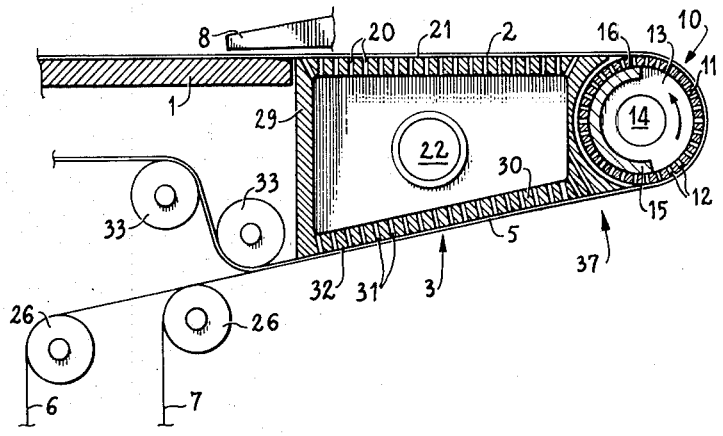
FIG. 5 is a section along line V—V of FIG. 4.
Figure 6:
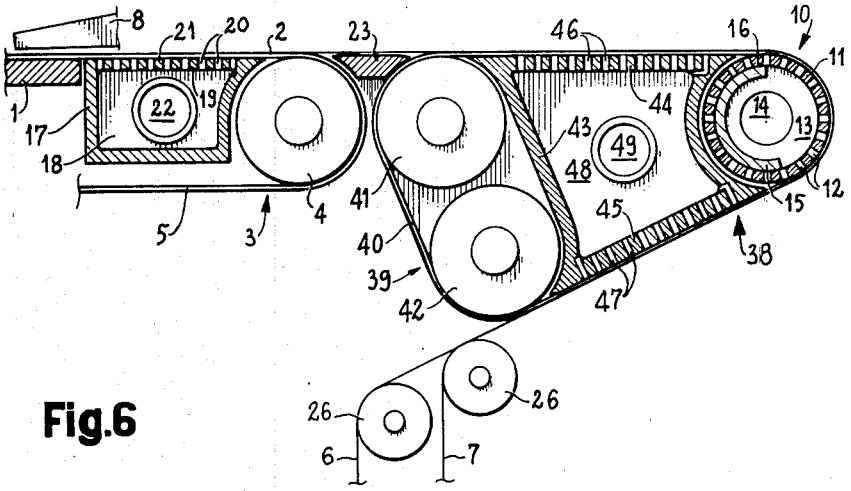
FIG. 6 is a diagrammatic axial section of a fourth embodiment of the strip guiding device according to the present invention.

In the device 28, the lower run of the belt conveyor 3 is deflected by a pair of pulleys 33 so as to slip in contact with the surface 32, and the two pulleys 26 are disposed substantially below the pulleys 33 and are substantially tangent to a plane passing through the surface 32. Finally, in the device 28, the plate 23 of the device 9 is replaced by a double plate 34 interposed between the pulleys 4 and 10. Plate 34 is limited in the upper portion by plane surface 35 which is substantially coplanar with surface 21 of the wall 19 and limited in the lower portion by plane surface 36 which is substantially coplanar with the surface 32 of wall 30. In use, the device 28 operates in a manner very similar to that of the device 9, with the only difference that, in the case of the device 28, the strips 6 and 7 are supplied to the pulley 10 by the belt conveyors 3 which adhere to the strips 6 and 7 in a position corresponding to the wall 30 of the box 29. The embodiment shown in FIGS. 4 and 5 relates to a strip guiding device 37 which is very similar to the device 28 and from which it differs in that it has no double plate 34 and no pulley 4, and in that this latter is replaced by the pulley 10 around which the belt conveyors are directly wound. In other terms, in the case of the device 37 the pulley 10 has the double function of actuating the belt conveyors 3 and deflecting the strips 6 and 7 above the bench 1. The embodiment shown in FIG. 6 relates to a strip guiding device 38 in which the arrangement and shape of the bench 1, the pulley 4, the belt conveyors 3, the plate 23 and the box 17 are substantially identical to those at the same elements of the device 9, from which latter the device 38 differs in that the pulley 10 is arranged in a different manner and has a different function.

In the device 38, the pulley 10 is disposed at a certain distance from the plate 23 and constitutes the driving pulley of a belt conveyor indicated generally be reference numeral 39.

This latter comprises a belt 40 closed in an annular fashion around three pulleys disposed according to the apexes of a triangle, of which a first side is substantially coplanar to the surface 21 of the wall 19 of the box 17 and extends between the pulley 10 and a pulley 41 adjacent the plate 23, a second side is inclined downwardly and extends between the pulley 41 and a second pulley 42, and a third side is inclined upwardly and extends between the pulley 42 and the pulley 10 in a plane substantially tangent to the deflector pulleys 26.

The belt 40 is made in such a way as to be air-permeable and surrounds a box 43 two walls of which, indicated by reference numerals 44 and 45, extend along the said first and third side of the said triangle, respectively.

Preferably, the belt 40 is formed by a perforated band of steel plate, and the walls 44 and 45 are provided with through holes 46 and 47 by means of which an inner chamber 48 of the box 43 communicates with the exterior. Chamber 48 has a conduit 49 through which it communicates with the said suction device (not shown).

The operation of the strip guiding device 38 is easily inferable from that of the strip guiding devices described hereinabove and does not require any further explanations.

Obviously, the strip guiding devices described hereinabove, although having been described in connection with cigarette making machines in which two paper strips are made to advance along a bench 1 for obtaining simultaneously two cigarette rods, may be adapted to the advancement of a single strip of paper by simply reducing the axial dimensions of the pulleys 4 and 10, as well as those of all the other conveyor elements.

I claim:

1. A strip guiding device, particularly for the automatic forward movement of at least a strip of paper along a substantially U-shaped path comprising a first and a second end branch connected to one another by an intermediate curved section, at least the said second branch, disposed downstream of the said curved section in the direction of advancement, extending, at least partially, along a conveyor device for the forward movement of the said strip, characterized in comprising at least a perforated pulley pivotally mounted about an axis passing through the centre of curvature of the said curved section, at least a chamber having a perforated wall disposed at least along the said second branch in contact with the said conveyor device, and suction means which communicate with the interior of the said pulley and the said chamber; a portion of the periphery of the said perforated pulley defining the said curved section of the path, and the remaining portion of the periphery of the said perforated pulley cooperating in a fluid-tight fashion with a fixed cylindrical surface; and the said conveyor device comprising an air-permeable ring-shaped belt conveyor.

2. A device as claimed in claim 1, characterized in that the said chamber has a second perforated wall extending along the said first branch of the said path.

3. A device as claimed in claim 1, characterized in that the said perforated pulley forms a driving pulley for the said air-permeable belt conveyor.

4. A device as claimed in claim 3, characterized in comprising a second conveyor device provided with a second air-permeable annular belt conveyor, and a second chamber which communicates with the said suction means and has a perforated wall disposed along the said second belt conveyor.

5. A device as claimed in claim 1, characterized in that a second pulley is arranged between said chamber and said perforated pulley; said belt conveyor extending about, and in contact with, said second pulley, and said perforated pulley being arranged outside said belt conveyor.

* * * * *